US006844502B2

(12) United States Patent
Deng et al.

(10) Patent No.: US 6,844,502 B2
(45) Date of Patent: Jan. 18, 2005

(54) HERMETICALLY SEALED CURRENT CONDUCTING TERMINAL ASSEMBLY

(75) Inventors: Zhijian Deng, Mason, OH (US); Tariq Quadir, West Chester, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/805,515

(22) Filed: Mar. 19, 2004

(65) Prior Publication Data

US 2004/0173370 A1 Sep. 9, 2004

Related U.S. Application Data

(63) Continuation-in-part of application No. 10/440,018, filed on May 16, 2003, now abandoned.

(60) Provisional application No. 60/380,994, filed on May 16, 2002.

(51) Int. Cl.[7] ..... H01B 17/26

(52) U.S. Cl. ..... 174/151; 174/50.61; 174/65 R; 174/153 R

(58) Field of Search ..... 174/65 G, 65 R, 174/66 SS, 151, 152 R, 152 GM, 153 R, 50.61

(56) References Cited

U.S. PATENT DOCUMENTS

| | | | | |
|---|---|---|---|---|
| 732,812 | A | | 7/1903 | Anderson |
| 1,218,216 | A | | 3/1917 | Schmid, Jr. |
| 1,391,944 | A | | 9/1921 | Dodgson |
| 1,845,699 | A | | 2/1932 | Brown |
| 1,941,397 | A | | 12/1933 | Grier |
| 2,057,452 | A | | 10/1936 | Scott |
| 2,060,757 | A | | 11/1936 | Hill |
| 2,107,353 | A | | 2/1938 | Vatter |
| 2,298,141 | A | | 10/1942 | Marbury |
| 2,373,720 | A | | 4/1945 | Stupakoff |
| 2,402,927 | A | | 6/1946 | Stupakoff |
| 2,439,394 | A | | 4/1948 | Lanzalotti et al. |
| 2,450,423 | A | | 10/1948 | Fraser et al. |
| 2,668,946 | A | | 2/1954 | Bennett |
| 2,672,500 | A | | 3/1954 | Bondon |
| 2,733,939 | A | | 2/1956 | Scherer |
| 2,748,187 | A | | 5/1956 | Conrad |
| 2,997,530 | A | | 8/1961 | Rosan |
| 3,107,757 | A | | 10/1963 | Breadner |
| 3,158,682 | A | * | 11/1964 | Goellner ..... 174/151 |
| 3,187,292 | A | | 6/1965 | Small et al. |
| 3,220,815 | A | | 11/1965 | McMillan et al. |
| 3,295,005 | A | | 12/1966 | Poellet et al. |
| 3,308,925 | A | | 3/1967 | Paterek |
| 3,352,963 | A | | 11/1967 | Homrig |
| 3,371,413 | A | | 3/1968 | Rundle |
| 3,389,215 | A | | 6/1968 | Rice et al. |
| 3,435,128 | A | * | 3/1969 | Dorwald ..... 174/151 |
| 3,605,076 | A | | 9/1971 | Dozier |
| 3,637,917 | A | | 1/1972 | Oates |
| 3,671,920 | A | | 6/1972 | Iantorno et al. |
| 3,688,006 | A | * | 8/1972 | Keller ..... 174/151 |
| 3,770,878 | A | | 11/1973 | Dozier |
| 3,979,187 | A | | 9/1976 | Scherer |
| 3,988,053 | A | | 10/1976 | Dodenhoff |
| 4,174,145 | A | | 11/1979 | Oeschger et al. |

(List continued on next page.)

*Primary Examiner*—Dean A. Reichard
*Assistant Examiner*—Adolfo Nino
(74) *Attorney, Agent, or Firm*—Harness, Dickey & Pierce, PLC

(57) ABSTRACT

A hermetically sealed current conducting terminal assembly for installation in an opening in the wall of a housing. The terminal assembly includes a current conducting pin assembly comprising a first pin member electrically connected to a second pin member at a conductive core and a first and second seal that electrically isolate the pin assembly from the housing.

57 Claims, 9 Drawing Sheets

U.S. PATENT DOCUMENTS

| | | | |
|---|---|---|---|
| 4,204,739 | A | 5/1980 | Shoenleben |
| 4,252,394 | A | 2/1981 | Miller |
| 4,329,540 | A | 5/1982 | Howarth |
| 4,480,151 | A | 10/1984 | Dozier |
| 4,584,433 | A | 4/1986 | Bowsky et al. |
| 4,609,774 | A | 9/1986 | LeMieux et al. |
| 4,940,858 | A | 7/1990 | Taylor et al. |
| 4,964,788 | A | 10/1990 | Itameri-Kinter et al. |
| 5,227,587 | A | 7/1993 | Paterek |
| 5,308,925 | A | 5/1994 | Paterek et al. |
| 5,493,073 | A | 2/1996 | Honkomp |
| 5,563,562 | A | 10/1996 | Szwec |
| 5,584,716 | A | 12/1996 | Bergman |
| 5,994,975 | A | 11/1999 | Allen et al. |
| 6,096,979 | A | 8/2000 | Kyle |
| 6,114,633 | A | 9/2000 | Duhancik |
| 6,156,978 | A | 12/2000 | Peck et al. |
| 6,274,252 | B1 | 8/2001 | Naugler et al. |
| 6,278,896 | B1 | 8/2001 | Stehlik et al. |
| 6,372,993 | B1 | 4/2002 | Eckels et al. |
| 6,441,311 | B2 | 8/2002 | Fukumoto et al. |
| 6,509,525 | B2 | 1/2003 | Honkomp et al. |
| 6,628,024 | B1 | 9/2003 | Mirmobin |

* cited by examiner

HERMETICALLY SEALED CURRENT CONDUCTING TERMINAL ASSEMBLY

CROSS-REFERENCE TO RELATED APPLICATIONS

This application is a continuation-in-part of U.S. patent application Ser. No. 10/440,018 filed on May 16, 2003, now abandoned which claims the benefit of U.S. Provisional Application No. 60/380,994 filed on May 16, 2002. The disclosures of the above applications are incorporated herein by reference.

FIELD OF THE INVENTION

The present invention relates to hermetically sealed, current conducting terminal assemblies suitable for installation in an opening in the wall of a housing.

BACKGROUND OF THE INVENTION

It is known to provide a hermetically sealed, current conducting terminal assembly that can be installed in a housing to provide an electrical connection through a wall of the housing, while electrically isolating the terminal assembly from the housing. Such terminal assembly incorporates a current conducting terminal pin, the outer segment of the pin being connected to an electrical power source and the inner segment of the pin being hermetically confined within the housing and connected to a device within the housing, such as a sealed motor unit, for example.

As shown in FIG. 8, a plurality of terminal assemblies 10 are extending through a housing plate 12 and walled housing 14. The housing plate 12 and walled housing 14 include a series of attachment apertures 16 and accompanying fasteners 18 for attaching the housing plate 12 to the walled housing 14. In addition, the housing plate 12 and walled housing 14 include a plurality of coaxially aligned threaded bores 20 for mating engagement with the terminal assemblies 10.

The terminal assemblies 10 are received by the threaded bores 20 of the housing plate 12 and walled housing 14. One terminal assembly arrangement can be found in U.S. Pat. No. 5,227,587, issued on Jul. 13, 1993 to F. Dieter Paterek, the general arrangement being particularly adapted to hermetically sealed housings. As shown in FIG. 9, the hermetic terminal assembly 10 of Paterek includes an annular sleeve 26, a hermetic seal 28, a pair of insulating annular ceramic sleeves 30, and a current conducting pin 32. The annular sleeve 26 includes a series of threads 34 for attaching the terminal assembly 10 to a threaded bore 20 of a housing plate 12 or walled housing 14. The current conducting pin 32 comprises a unitary body having a first threaded end 36 and a second threaded end 38. The first threaded end 36 and second threaded end 38 are operable to connect to an external source generally disposed outside of the walled housing 14 and an internal source disposed within the walled housing 14, respectively.

The hermetic seal 28 and annular ceramic sleeves 30 electrically isolate the current conducting pin 32 from the annular sleeve 26. In this regard, the hermetic seal 28 and annular ceramic sleeves 30 allow the current conducting pin 32 to transmit electricity into and out of the walled housing 14 without transmitting electricity to the housing wall 40.

The terminal assemblies described above may be comparatively expensive and difficult to manufacture. Therefore, a hermetically sealed terminal assembly that is easier and less expensive to manufacture while concurrently providing for the effective electrical isolation between a current conducting pin and a housing is desirable in the industry.

SUMMARY OF THE INVENTION

The invention provides a self-contained, hermetically sealed terminal assembly. The invention is suitable for installation in the wall of a housing or in a housing plate.

In one aspect of the invention, the terminal assembly comprises a multi-component, current conducting pin assembly having a first pin member and a second pin member that are joined at a core. In at least some embodiments of the invention, the core physically and/or electrically connects the first and second pin members of the pin assembly. An annular sleeve is axially disposed around pin assembly. The pin assembly is fused to the annular sleeve by a glass-to-metal seal that provides a first electrically insulating hermetic seal between the pin assembly and the annular sleeve. In addition, first and second sleeves are disposed over the first and second pin members on opposite sides of the core to provide a second electrically insulating seal and oversurface protection between the pin assembly and the annular sleeve.

In another aspect of the invention, the pin assembly comprises a copper pin and a stainless steel collar or tube that is joined to the pin, such as by brazing. The pin may be a single piece or comprise a multi-component design.

In yet another aspect of the invention, a terminal assembly comprises a plurality of pin assemblies as described herein.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
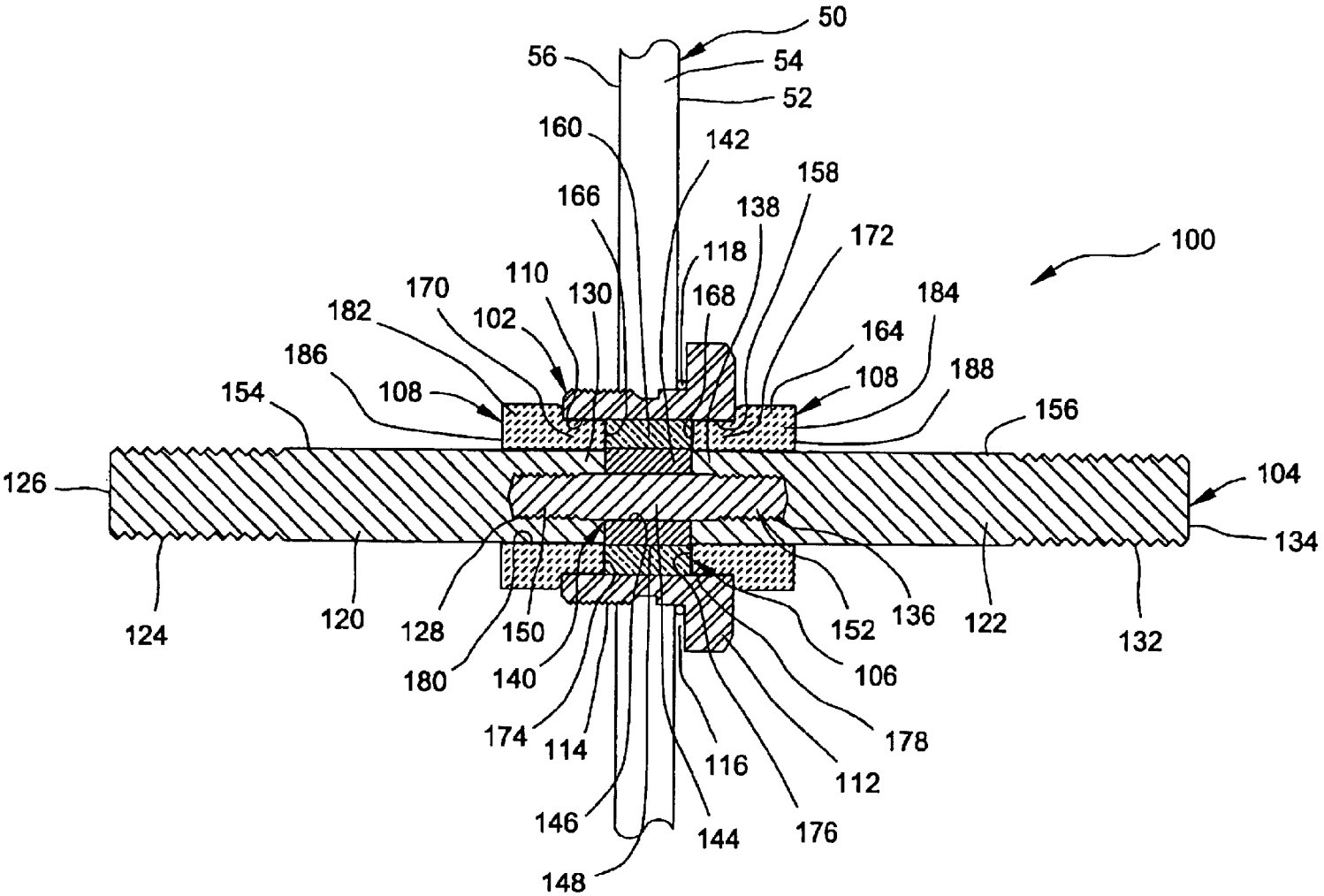
FIG. 1 is cross-sectional front view showing a terminal assembly installed in a housing, the terminal assembly comprising a pin assembly including first and second pin members and a core comprising a cylindrical collar and a stud portion having threaded extensions.

FIGS. 1 though 7 show various configurations of a hermetically sealed, current conducting pin installation 100, 200, 300, 400, 500, 600, 700 for mounting in a wall of a hermetically sealed housing 50. The housing 50 can enclose a comparatively large size electric device demanding high operating voltages and currents, such as a compressor with a rating as high as three hundred (300) horsepower, for example. A control unit that conventionally demands lower current and voltage ratings may also be included (not shown) within the sealed housing 50. The different power requirements for both the compressor and the control unit may be carried by hermetically sealed, current conducting pin installation 100, 200, 300, 400, 500, 600, 700. It is to be understood that the several features of the present invention, although particularly suitable for sealed housings of larger type compressor and control units, are not to be considered as limited to the particular size and shape disclosed and, that such features can also be utilized with other devices, such as those with lower power requirements.

With particular reference to FIG. 1, a first embodiment of the hermetically sealed current conducting pin installation 100 is shown as including an annular sleeve 102, a pin assembly 104, a hermetic seal 106, and a second electrical insulator 108.

The annular sleeve 102 is a substantially cylindrical member having a bore 110, an axial flange 112 at a first end, and a threaded portion having threads 114 adapted to matingly engage corresponding threads of a larger opening in a housing 50. The junction of the threaded portion and the axial flange 112 cooperate to form an axial recess 116 where an O-ring 118 is disposed for engagement with an outer wall of the housing 50 to create a seal. While an O-ring 118 is disclosed, any suitable gasket could be used to adequately seal the outer surface of the housing wall and the axial flange 112 of the annular sleeve 102 and should be considered within the scope of the invention.

The pin assembly 104 includes a first longitudinal pin member 120 and a second longitudinal pin member 122, each of which are formed from a current conducting material such as copper or brass. The first pin member 120 is substantially cylindrical and has a generally constant diameter along its length. The first member 120 includes a threaded portion 124 at a distal end 126 and a threaded bore 128 at a proximal end 130.

The second pin member 122 is also substantially cylindrical and has a constant diameter along its length. The second pin member 122 similarly includes a threaded portion 132 at a distal end 134 and a bore 136 formed at a proximal end 138. While the present invention discloses that the pin members 120, 122 are formed from stainless steel, it should be noted that any suitable conductive material may be used and should be considered within the scope of the present invention.

The pin assembly 104 also includes a core 140 that serves to physically join together and electrically connect the first and second longitudinal pin members 120, 122. The core 140 includes a stainless steel tube or collar 142 and a central member or stud portion 144 formed from a conductive material such as, for example, copper. The collar 142 includes an inner surface 146 and an outer surface 148. The outer surface 148 has a diameter that is generally the same as the diameter of the pin members 120, 122. The collar 142 surrounds the stud 144 at its midpoint such that first and second extension portions 150, 152 of the stud 144 extend away from the collar 142 in opposite directions. The collar 142 is brazed to the stud 144 at the inner surface 146 to fixedly attach the collar 142 to the stud 144.

The stud 144 has a generally cylindrical shape and is disposed between the first and second longitudinal pin members 120, 122. The first extension portion 150 of the stud 144 is received in the bore 128 of the first pin member 120 and the second extension portion 152 of the stud 144 is received in the bore 136 of the second member 122. The first and second longitudinal pin members 120, 122 are joined together via the stud 144.

The outer surface 148 of the collar 142 has a diameter that is generally equivalent to the diameter of the longitudinal pin members 120, 122. Thus, the outer surface 148 of the collar 142 is generally flush with both the outer surface 154 of the first longitudinal pin member 120 and the outer surface 156 of the second longitudinal pin member 122.

While the stud 144 described above is formed from copper, other conductive materials such as brass, for example, may be used and should be considered within the scope of the present invention.

The first insulator and seal 106 is disposed between the outer surface 148 of the collar 142 and an inner surface 158 of annular sleeve 102 to hermetically seal and electrically insulate the pin assembly 104 from the annular sleeve 102. Insulator and seal 106 provides a hermetic seal 160 and may comprise a glass-to-metal seal that is well known to those in the art. The glass-to-metal seal may be fused to both the pin assembly 104 and inner surface 158 of the annular sleeve 102.

The second insulator 108 comprises a pair of opposed, annular ceramic sleeves 162, 164 that surround the first and second longitudinal pin members 120, 122 of the pin assembly 104 at their respective proximal ends 130, 138. The second insulator 108 provides oversurface protection for the pin members 120, 122 to further insulate the pin assembly 104 from both the annular sleeve 102 and the housing 50. Each of the insulating sleeves 162, 164 is disposed in mirror-image relation to one another on opposite faces 166, 168 of the hermetic seal 160 and are so contoured that a lower extremity face 170, 172 of a smaller diameter portion 174, 176 of the insulating sleeves 162, 164 can be fused or epoxy glued to the faces 166, 168 of the hermetic seal 160.

The smaller diameter portions 174, 176 of the insulating sleeves 162, 164 abut the inner surface 158 of externally threaded annular sleeve 102 on a first side 178 and abut the outer surfaces 154, 156 of the longitudinal pin members 120, 122 of the pin assembly 104 on a second side 180. A larger diameter annular shoulder 182, 184 of each insulating sleeve 162, 164 is arranged to overlap the outer face extremities 186, 188 of the annular sleeve 102.

As previously discussed, the first and second insulators 106, 108 are operable to electrically isolate the pin assembly 104 from the annular sleeve 102. In this manner, the current conducting pin installation 100 may be attached to the housing 50 via the annular sleeve 102 and an electric current may pass through the pin assembly 104 between sides 52, 56 of a housing wall 54.

Figure 2:
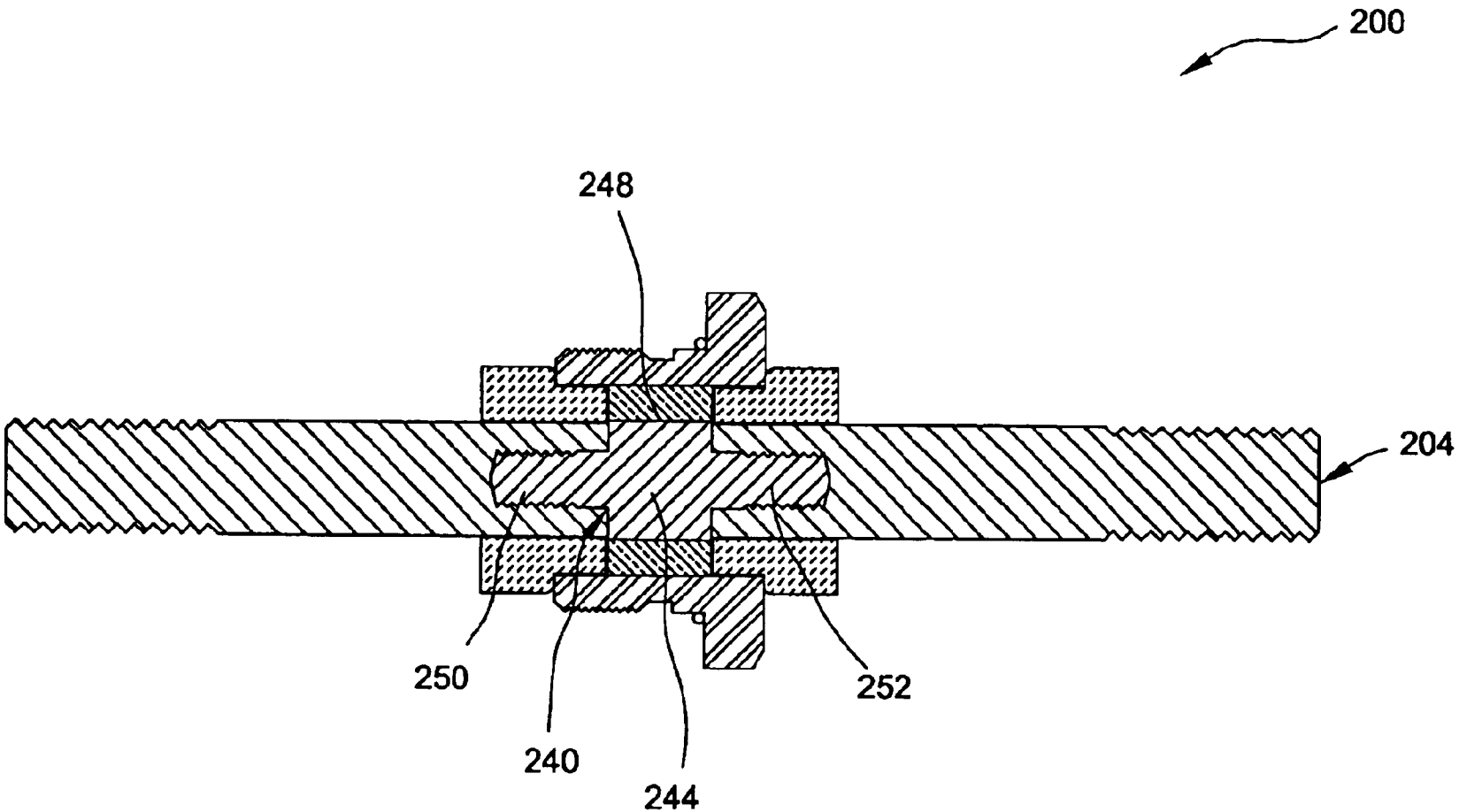
FIG. 2 is cross-sectional front view showing another embodiment of a terminal assembly comprising a pin assembly including first and second pin members and a core comprising a cylindrical collar portion and threaded extension portions having a unitary construction.

With particular reference to FIG. 2, a second embodiment of the hermetically sealed current conducting pin installation 200 is shown having an annular sleeve 102, first and second insulators 106, 108, and a pin assembly 204.

In general, the hermetically sealed current conducting pin installation 200 is substantially similar to the hermetically sealed current conducting pin installation 100 described above. In view of the substantial similarity in structure and function of the components associated with the hermetically sealed current conducting pin installation 100 and the hermetically sealed current conducting pin installation 200, like reference numerals are used here and in the drawings to identify like components.

The pin assembly 204 of this embodiment comprises a core 240 having unitary construction, including a central cylindrical collar portion 244 and first and second extension portions or studs 250, 252. The central collar portion 244 has an outer surface 248 that is generally equivalent to that of the pin members 120, 122. The central collar portion 244 is attached to the first insulator and seal 106 along the outer surface 248. The first and second extension portions 250, 252 are received in the first and second pin members 120, 122 of the pin assembly 204, thereby joining the first and second members 120, 122 of the pin assembly 204 to the central collar portion 244, as previously discussed.

Figure 3:
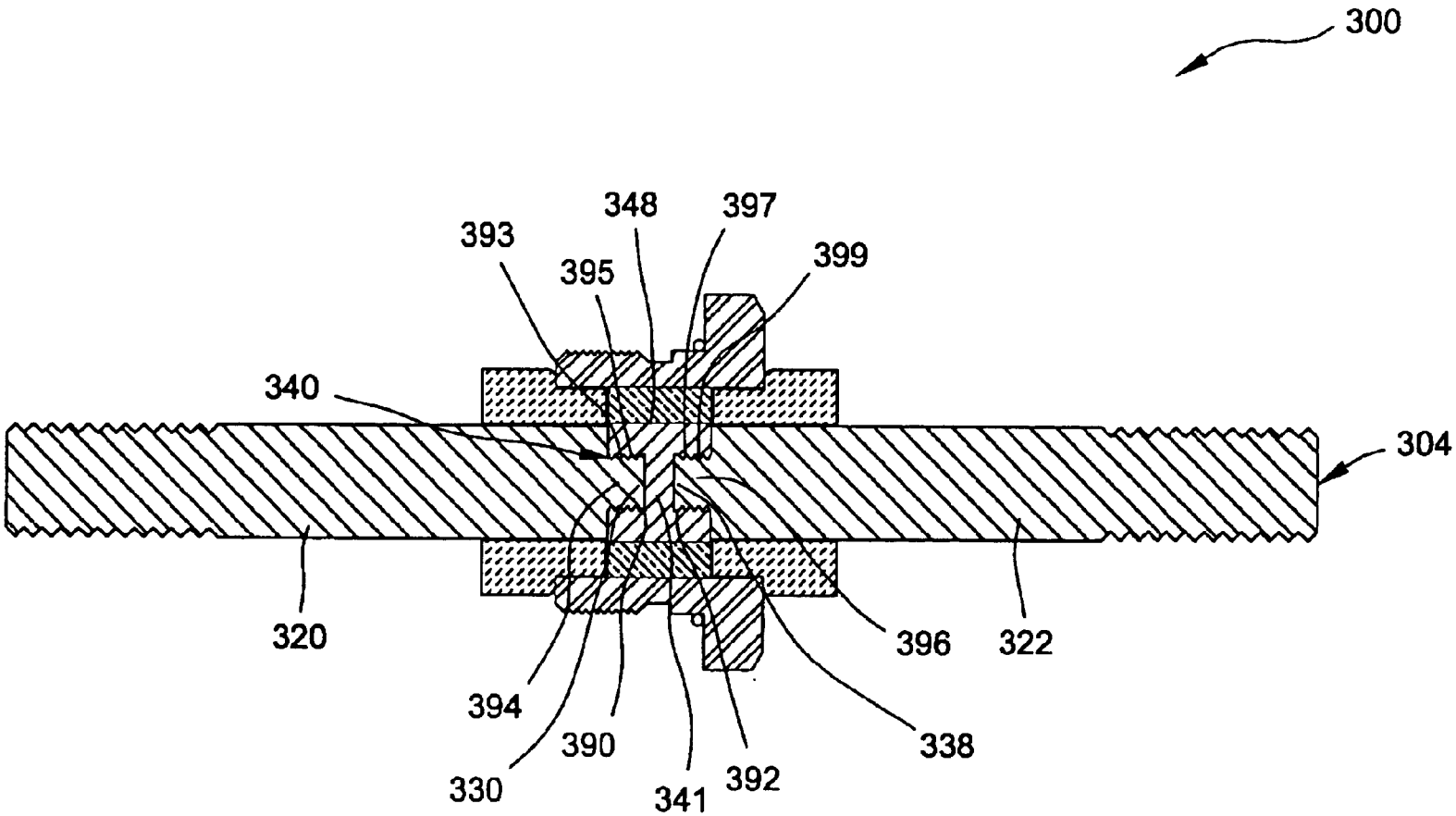
FIG. 3 is cross-sectional front view of another embodiment of a terminal assembly comprising a pin assembly including first and second pin members and a cylindrical collar comprising two internally threaded blind bores each for receiving one of the first and second pin members.

With particular reference to FIG. 3, a third embodiment of the hermetically sealed current conducting pin installation 300 is shown having an annular sleeve 102, a first and second insulators 106, 108, and a pin assembly 304.

The hermetically sealed current conducting pin installation 300 is substantially similar to the hermetically sealed current conducting pin installation 100 described above. In view of the substantial similarity in structure and function of the components associated with the hermetically sealed current conducting pin installation 100 and the hermetically sealed current conducting pin installation 300, like reference numerals are used here and in the drawings to identify like components.

The pin assembly 300 has a core 340 comprising a cylindrical collar 341 that includes first and second blind threaded bores 390, 392 and an outer surface 348. The outer surface 348 is generally the same in diameter as the diameters of pin members 320, 322 of the pin assembly 304. The core 340 is attached to the first insulator and seal 106 generally at the outer surface 348 and serves to insulate the pin assembly 304 from the annular sleeve 102.

The pin assembly 304 includes the first longitudinal pin member 320 and the second longitudinal pin member 322 which are physically joined together and electrically connected by the core 340. The first pin member 320 includes a first cylindrical post 394 extending from its proximal end 330. The post 394 includes external, male threads 393 for interaction with corresponding internal, female threads 395 in the core 340. Similarly, the second pin member 322 includes a second cylindrical post 396 extending from its proximal end 338 having external, male threads 397 for interaction with corresponding internal female threads 399 in the core 340. The first and second posts 394, 396 are received, respectively, in the first and second threaded bores 390, 392 of the core 340 such that both the first pin member 320 and the second pin member 322 are connected with the core 340.

Figure 4:
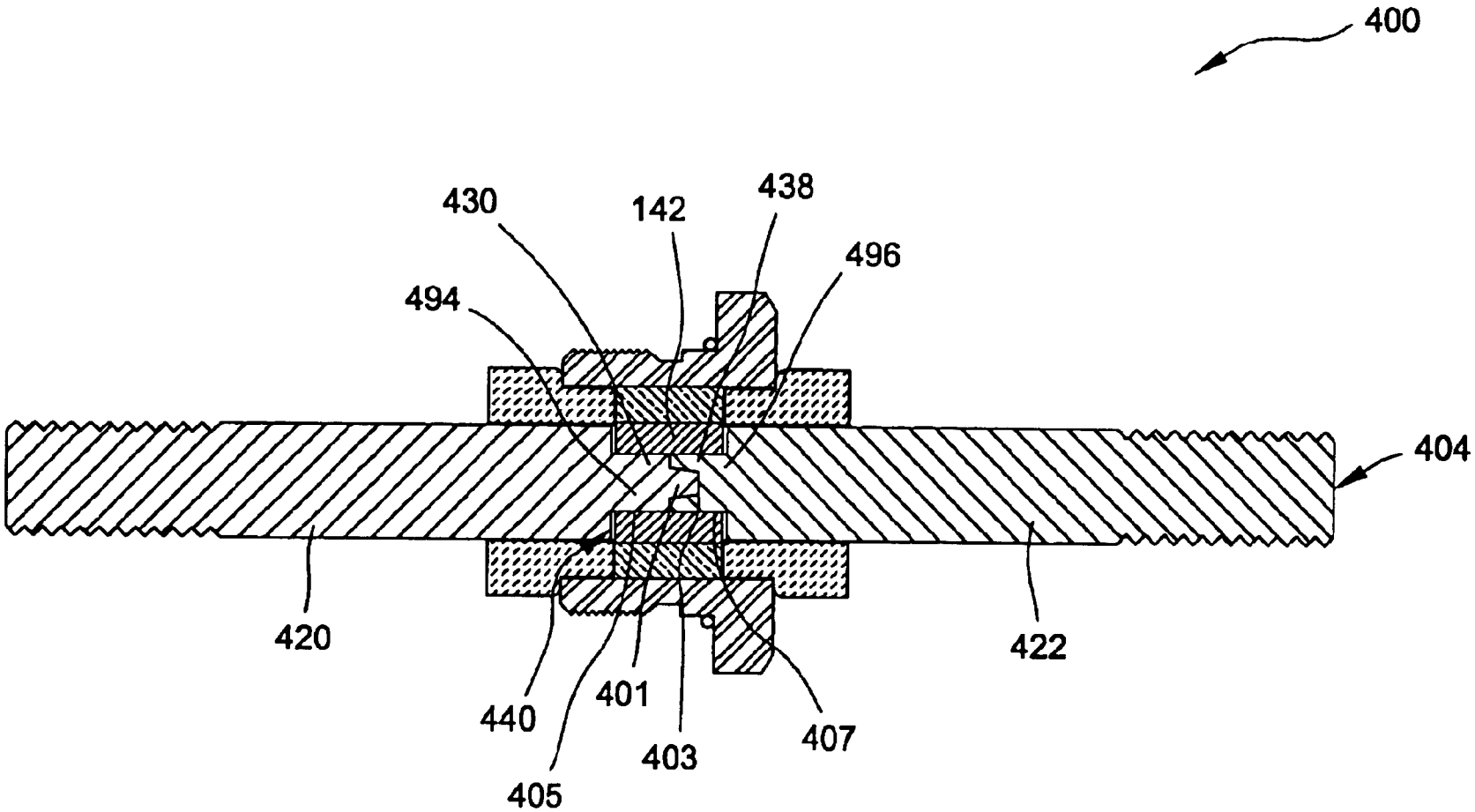
FIG. 4 is cross-sectional front view of a fourth embodiment of a terminal assembly including a pin assembly comprising first and second pin members and a cylindrical collar having a bore for receiving the first and second pin members.

With particular reference to FIG. 4, a fourth embodiment of the hermetically sealed current conducting pin installation 400 is shown. Current conducting pin installation 400 is illustrated as having an annular sleeve 102, first and second insulators 106, 108, and a pin assembly 404.

In general, the hermetically sealed current conducting pin installation 400 is substantially similar to the hermetically sealed current conducting pin installation 100 described above. In view of the substantial similarity in structure and function of the components associated with the hermetically sealed current conducting pin installation 100 and the hermetically sealed current conducting pin installation 400, like reference numerals are used here and in the drawings to identify like components.

The pin assembly 404 includes a core 440, a first pin member 420 and a second member 422. The first and second pin members 420, 422 are operable to directly engage one another to become physically and electrically connected. Specifically, the first member 420 includes a frustum 401 formed at the proximal end 430 of a first cylindrical post 494 for mating engagement with a tapered bore 403 formed in a second cylindrical post 496 of the second member 422 where the second cylindrical post 496 is formed in the proximal end 438 of the second pin member 422.

The core 440 surrounds the connection between the first and second posts 494, 496. The core 440 comprises a stainless steel tube or collar 142 having an inner surface 146 and an outer surface 148. The inner surface 146 engages outer surfaces 405, 407 of each of the first and second cylindrical posts 494, 496 and the outer surface 148 is attached to the first seal 106. The collar 142 abuts the first and second members 420, 422 of the pin assembly 404 such that the outer surface 148 of the collar 142 and the outer surfaces 154, 156 of the first and second pin members 420, 422 are flush relative one another.

Figure 5:
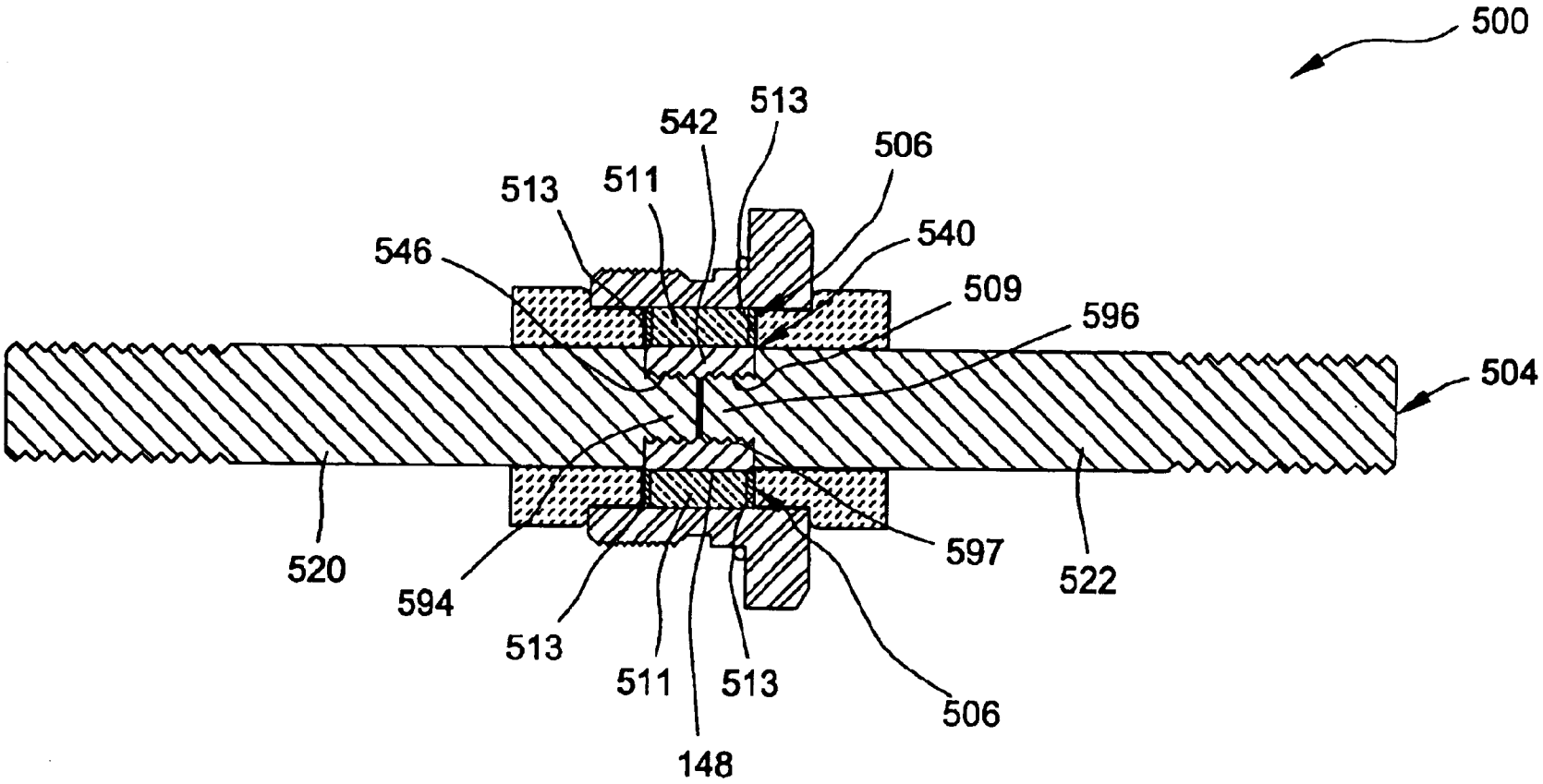
FIG. 5 is a cross-sectional front view of another embodiment a terminal assembly including a pin assembly comprising first and second pin members and a collar having a threaded through bore for receiving both the first and second pin members.

Referring now to FIG. 5, a fifth embodiment of the hermetically sealed current conducting pin installation 500 is shown. The hermetically sealed current conducting pin installation 500 is substantially similar to the hermetically sealed current conducting pin installation 100 described above. In view of the substantial similarity in structure and function of the components associated with the hermetically sealed current conducting pin installation 100 and the hermetically sealed current conducting pin installation 500, like reference numerals are used here and in the drawings to identify like components.

The current conducting pin installation 500 is shown as comprising an annular sleeve 102, a first insulator and seal 506, a second insulator 108, and a pin assembly 504. The pin assembly 504 comprises a core 540, a first pin member 520 and a second pin member 522. The first member 520 includes a first extension 594 having external male threads 593 that are aligned adjacent to a second extension 596 of the second pin member 522, which similarly includes external male threads 597. The opposing end faces of the first and second extensions 594, 596 may be joined by a suitable method such as, but not limited to, brazing.

The core 540 surrounds the interface between the first and second posts 594, 596 and is operable to join the first and second members 520, 522 to the first insulator and seal 506. The core 540 comprises a stainless steel tube or collar 542 having an inner surface 546 including a series of threads 509 for mating engagement with the first and second threads 593, 597 of the first and second cylindrical posts 594, 596. In addition, the collar 542 includes an outer surface 148 for attachment to the first insulator and seal 506. The collar 542 abuts the first and second pin members 520, 522 of the pin assembly 504 such that the outer surface 148 of the collar 542 and outer surfaces 154, 156 of the first and second members 520, 522 are flush relative one another.

The first seal 506 includes a central portion 511 formed from a suitable glass material flanked by a pair of epoxy layers 513. The epoxy layers 513 serve to attach the central portion 511 of the first insulator and seal 506 to the outer surface 148 of the collar 542 and also to the smaller diameter portions 174, 176 of the second insulator 108 to ensure a constant seal between the pin assembly 504 and the first and second insulators 506, 108.

From the above description, it can be seen that a hermetically sealed current conducting terminal assembly is provided for ready insertion and maintenance removal. Further, each embodiment provides a novel approach to construction of a hermetically sealed current conducting terminal assembly that provides for a reduction in manufacturing time, effort and cost.

Figure 6:
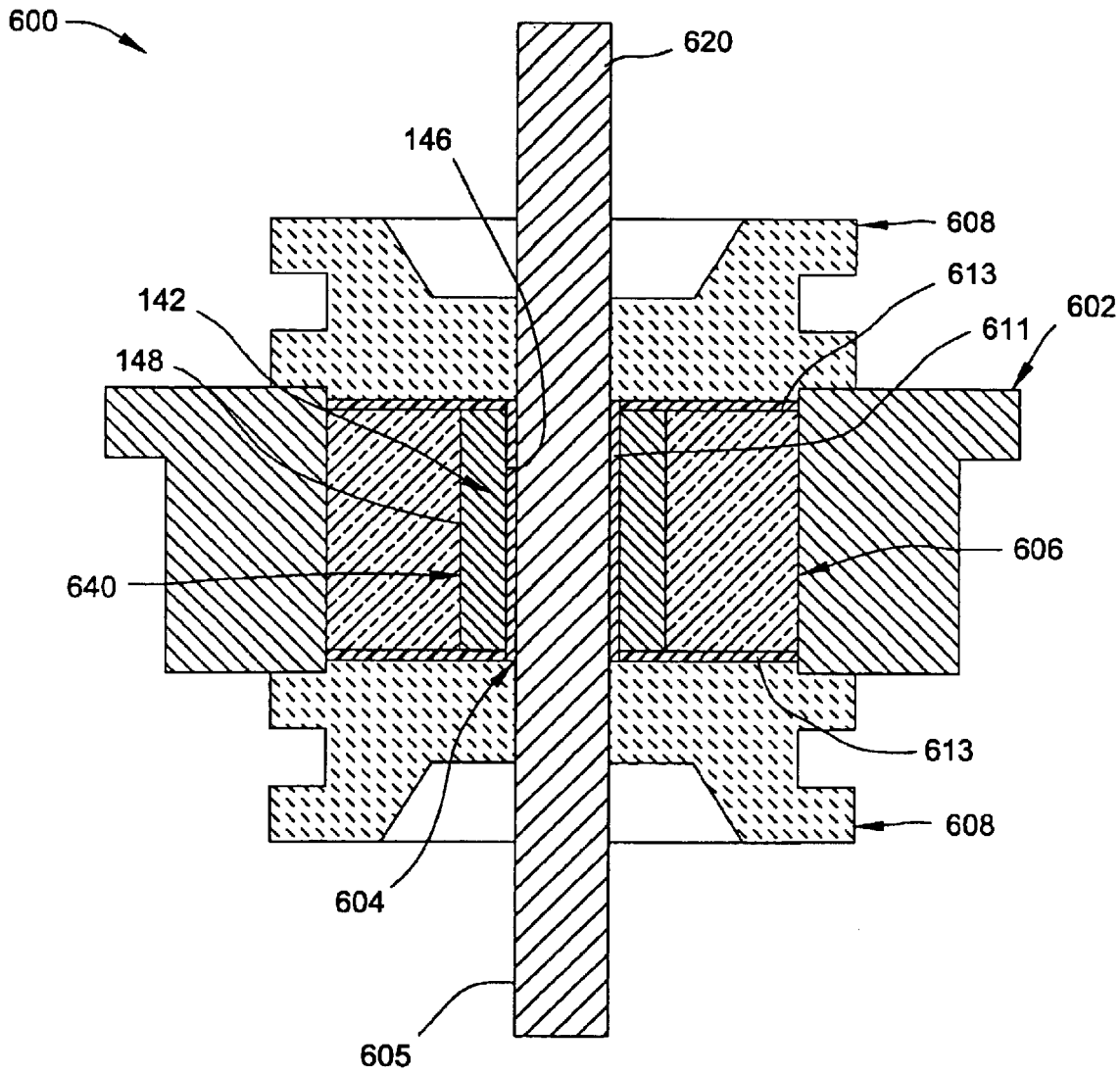
FIG. 6 is a cross-sectional front view of another embodiment a terminal assembly including a unitary pin assembly, a stainless steel collar, and a glass seal.

With particular reference to FIG. 6, a sixth embodiment of the hermetically sealed current conducting pin installation 600 is shown. Current conducting pin installation 600 is illustrated as having an annular sleeve 602, first and second insulators 606, 608, and a pin assembly 604.

In general, the hermetically sealed current conducting pin installation 600 is substantially similar to the hermetically sealed current conducting pin installation 100 described above. In view of the substantial similarity in structure and function of the components associated with the hermetically sealed current conducting pin installation 100 and the hermetically sealed current conducting pin installation 600, like reference numerals are used here and in the drawings to identify like components.

The pin assembly 604 includes a core 640 and a unitary pin 620. The pin 620 is preferably made from copper and extends through the first and second insulators 606, 608, as best shown in FIG. 6. The pin 620 is insulated from the annular sleeve 602 by the first and second insulators 606, 608 such that current passing though the pin 620 is not transmitted to the annular sleeve 602.

The core 640 generally surrounds the pin 620 and serves to join the pin 620 to the first insulator 606. The core 640 comprises a stainless steel tube or collar 142 having an inner surface 146 and an outer surface 148. The inner surface 146 engages an outer surface 605 of the pin 620 while the outer surface 148 is attached to the first insulator 606. Specifically, the inner surface 146 is joined to the outer surface 605 of the pin 620 by a braze 611 such that the collar 142 is electrically connected to the pin 620. The braze may comprise any suitable electrical conductor but is preferably a silver braze formed from a material such as 56Ag/42Cu/2Ni. In addition, the collar 142 and first insulator 606 are joined to the second insulator 608 by a suitable epoxy 613, as best shown in FIG. 6. The epoxy 613 prevents a gap from forming between the first insulator 606 and the second insulators 608 in order to ensure that the pin 620 is electrically isolated from the annular sleeve 602 along its length.

As described, the stainless steel tube 142 is disposed generally between the pin 620 and the first insulator 606. In one embodiment, the first insulator 606 is a suitable glass seal, thereby forming a glass-to-metal seal between the stainless steel tube 142 and the annular sleeve 602. The relationship between the stainless steel tube 142 and the glass seal 606 allows the pin 620 to be formed from a highly conductive material (i.e. copper) that ordinarily would not fuse well with the glass seal 606. The stainless steel tube 142 fuses well with both copper and glass, and thus, allows for the use of the copper pin 620. In other words, the stainless steel tube 142 acts as a bridge between the copper pin 620 and the glass seal 606. As can be appreciated, using a copper pin provides the terminal assembly 600 with the ability to carry a higher current, and thus, allows the terminal assembly 600 to be used in a wider range of applications.

Figure 7:
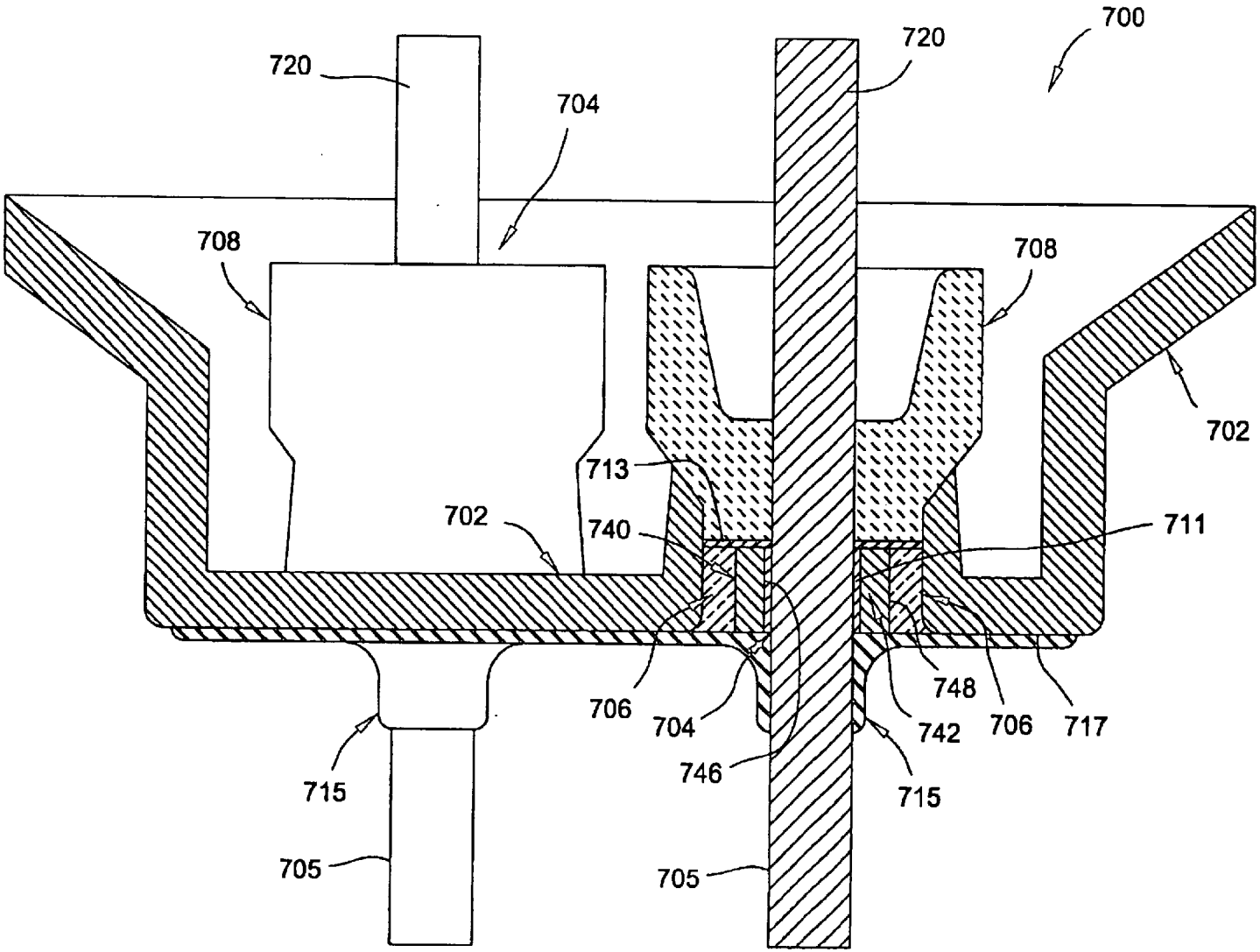
FIG. 7 is a cross-sectional view of another embodiment of a terminal assembly including a plurality of pin members having a stainless steel collar and a glass seal disposed generally between each pin member and an annular sleeve.
Figure 8:
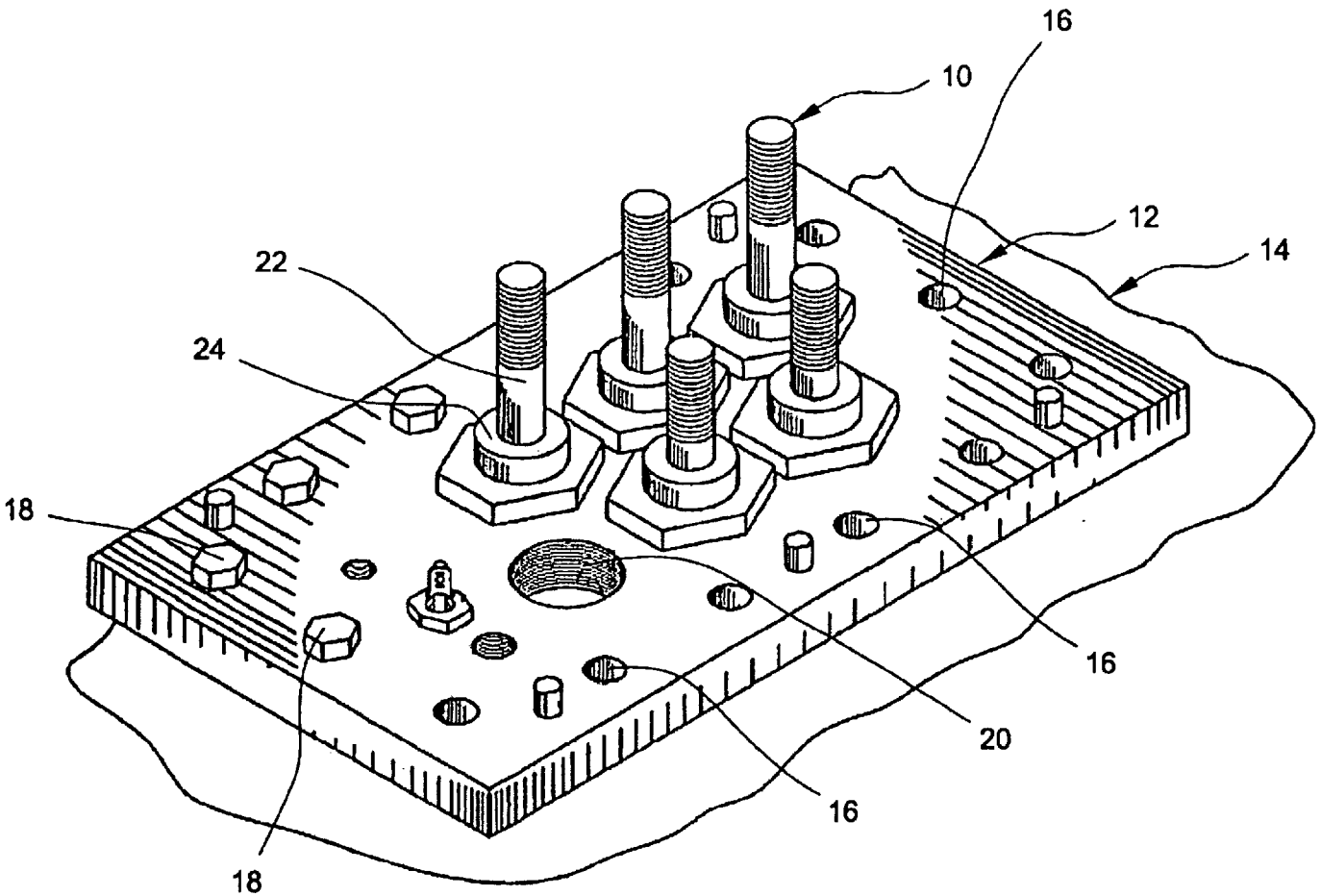
FIG 8 PRIOR ART
FIG. 8 is a perspective view of a housing plate and walled housing including a plurality of hermetically sealed, current conducting terminal assemblies.
Figure 9:
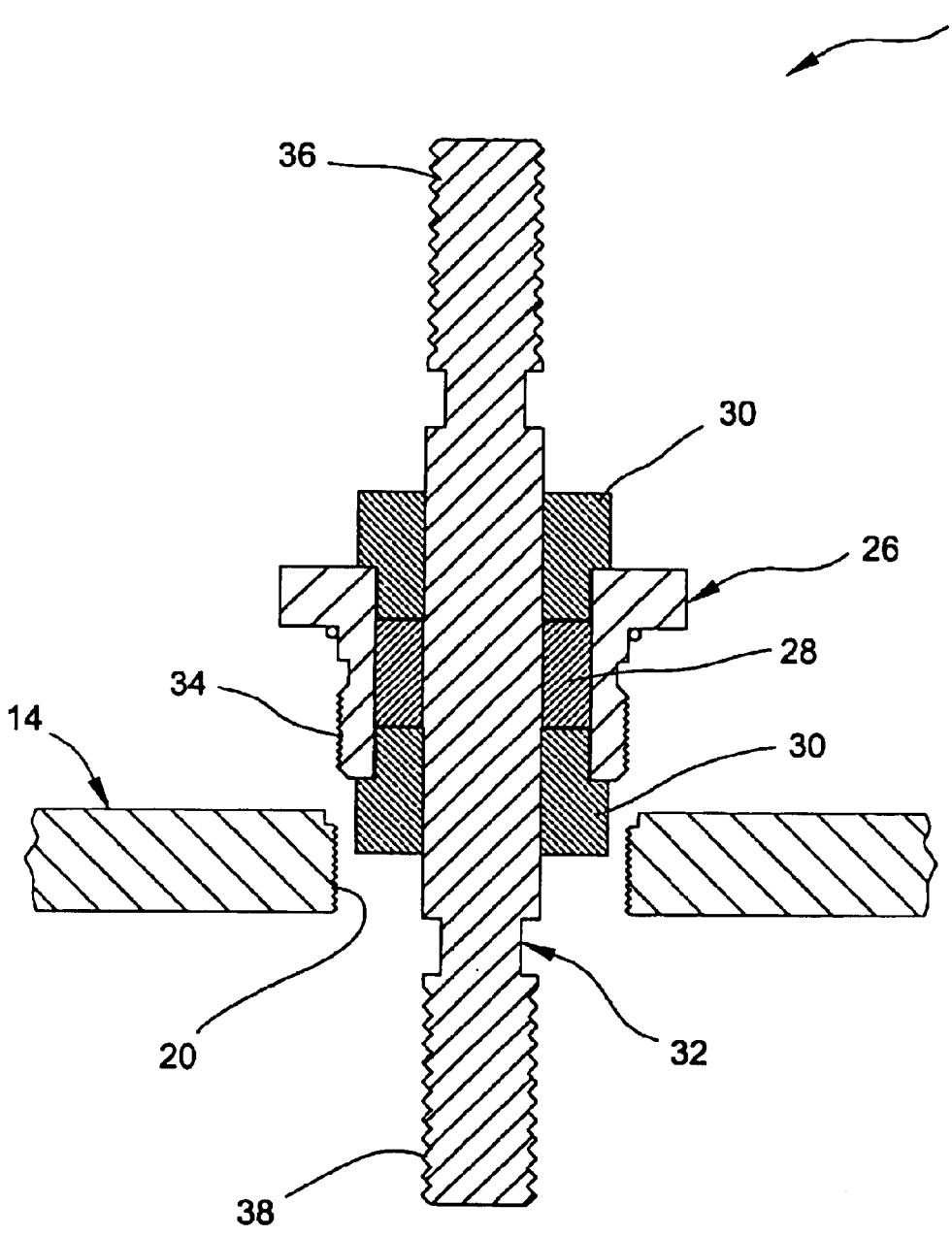
FIG 9 PRIOR ART
FIG. 9 is a terminal assembly having a current conducting pin of unitary construction.

With particular reference to FIG. 7, a seventh embodiment of the hermetically sealed current conducting pin installation 700 is shown. Current conducting pin installation 700 is illustrated as having an annular sleeve 702, first and second insulators 706, 708, and a plurality of pin assemblies 704.

In general, the hermetically sealed current conducting pin installation 700 is substantially similar to the hermetically sealed current conducting pin installation 100 described above. In view of the substantial similarity in structure and function of the components associated with the hermetically sealed current conducting pin installation 100 and the hermetically sealed current conducting pin installation 700, like reference numerals are used here and in the drawings to identify like components.

Each pin assembly 704 includes a core 740 and a unitary pin 720. The pin 720 is preferably made from copper and extends through the first and second insulators 706, 708, as best shown in FIG. 7. The pin 720 is insulated from the annular sleeve 702 by the first and second insulators 706, 708 such that current passing though the pin 720 is not transmitted to the annular sleeve 702. A third insulator 715 partially surrounds a top surface 717 of the annular sleeve 702 to further insulate each pin 720 from contact with the annular sleeve 702. The third insulator 715 locally conforms to the generally cylindrical shape of each pin 720 and is preferably formed from a non-conductive material such as rubber, as best shown in FIG. 7.

The core 740 surrounds the pin 720 and serves to join the pin 720 to the first insulator 706. The core 740 comprises a stainless steel tube or collar 742 having an inner surface 746 and an outer surface 748. The inner surface 746 engages an outer surface 705 of the pin 720 while the outer surface 748 is attached to the first insulator 706, as best shown in FIG. 7. Specifically, the inner surface 746 is joined to the outer surface 705 of the pin 720 by a braze 711 such that the collar 742 is electrically connected to the pin 720. The braze may comprise any suitable electrical conductor but is preferably a silver braze formed from a material such as 56Ag/42Cu/2Ni. In addition, the collar 742 and first insulator 706 are joined to the second insulator 708 by a suitable epoxy 713, as best shown in FIG. 7. The epoxy 713 prevents a gap from forming between the first insulator 706 and the second insulator 708 in order to ensure that the pin 720 is electrically isolated from the annular sleeve 702 along its length.

As described, the stainless steel tube 742 is disposed generally between the pin 720 and the first insulator 706. In one embodiment, the first insulator 706 is a suitable glass seal, thereby forming a glass-to-metal seal between the stainless steel tube 742 and the annular sleeve 702. The relationship between the stainless steel tube 742 and the glass seal 706 allows the pin 720 to be formed from a highly conductive material (i.e. copper) that ordinarily would not fuse well with the glass seal 706. The stainless steel tube 742 fuses well with both copper and glass and thus allows for the use of the copper pin 720. In other words, the stainless steel tube 742 acts as a bridge between the copper pin 720 and the glass seal 706. As can be appreciated, using a copper pin provides the terminal assembly 700 with the ability to carry a higher current, and thus, allows the terminal assembly 700 to be used in a wider range of applications.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A hermetically sealed current conducting terminal assembly comprising:

an annular sleeve comprising a bore and a first and second end;

a pin assembly disposed within said bore of said sleeve;

a first insulator disposed between said bore of said sleeve and said pin assembly, said first insulator electrically insulating said pin assembly from said sleeve;

said pin assembly comprising:

a pin member;

a collar operable to connect said pin member to said first insulator; and a second insulator comprising at least one ceramic sleeve disposed about said pin member and adjacent to said first insulator.

2. The terminal assembly of claim 1, wherein said collar is made from stainless steel.

3. The terminal assembly of claim 1, wherein said collar axially surrounds an outer diameter of said pin member.

4. The terminal assembly of claim 1, wherein said pin member comprises a first pin member and a second pin member, said first pin member electrically connected to said second pin member at said collar.

5. The terminal assembly of claim 1, wherein said pin member includes a unitary construction.

6. The terminal assembly of claim 1, wherein said pin member is made from copper.

7. The terminal assembly of claim 1, wherein said collar is fused to said pin member by an electrical conductor.

8. The terminal assembly of claim 7, wherein said electrical conductor is a braze.

9. The terminal assembly of claim 7, wherein said electrical conductor is a silver braze, said silver braze operable to electrically join said pin member and said collar.

10. The terminal assembly of claim 1, wherein said first insulator is a glass-to-metal seal.

11. The terminal assembly of claim 1, wherein said second insulator is bonded to an opposite side of said first insulator and said collar by a bonding material.

12. The terminal assembly of claim 11, wherein said bonding material is an epoxy.

13. The terminal assembly of claim 1, wherein said second insulator extends beyond one of said first and second ends of said annular sleeve to provide oversurface protection between said pin assembly and said annular sleeve.

14. The terminal assembly of claim 1, wherein said annular sleeve includes an external threaded portion, said external threaded portion operable to attach said hermetic assembly to a corresponding threaded bore.

15. The terminal assembly of claim 1, wherein said first pin member includes a first extension and said second pin member includes a second extension, said first extension extending in said second direction from said proximal end of said first pin member and said second extension extending in said first direction from said proximal end of said second pin member.

16. The terminal assembly of claim 15, wherein said core includes a first threaded blind bore and a second threaded blind bore, said first threaded blind bore operable to matingly receive said first extension of said first pin member and said second blind bore operable to matingly receive said second extension of said second pin member.

17. The terminal assembly of claim 15, wherein said core includes a bore extending therethrough, said bore operable to matingly receive said first extension of said first pin member and said second extension of said second pin member.

18. The terminal assembly of claim 17, wherein said bore includes threaded portion, said threaded portion operable to matingly receive said first extension of said first pin member and said second extension of said second pin member.

19. The terminal assembly of claim 15, wherein said first extension is directly joined to said second extension.

20. The terminal assembly of claim 15, wherein said first extension is joined to said second extension by brazing.

21. The terminal assembly of claim 20, wherein said braze is a silver braze.

22. A hermetically sealed current conducting terminal assembly comprising:

an annular sleeve comprising at least one bore;

a pin assembly disposed within said bore of said sleeve;

a first insulator disposed between said bore of said sleeve and said pin assembly, said first insulator electrically insulating said pin assembly from said sleeve;

said pin assembly comprising:

a pin member; and a collar operable to connect said pin member to said first insulator; and a second insulator comprising at least one ceramic sleeve disposed about said pin member and adjacent to said first insulator.

23. The terminal assembly of claim 22, wherein said collar is made from stainless steel.

24. The terminal assembly of claim 22, wherein said collar axially surrounds an outer diameter of said pin member.

25. The terminal assembly of claim 22, wherein said pin member comprises a first pin member and a second pin member, said first pin member electrically connected to said second pin member at said collar.

26. The terminal assembly of claim 22, wherein said pin member includes a unitary construction.

27. The terminal assembly of claim 22, wherein said pin member is made from copper.

28. The terminal assembly of claim 22, wherein said collar is fused to said pin member by an electrical conductor.

29. The terminal assembly of claim 28, wherein said electrical conductor is a braze.

30. The terminal assembly of claim 28, wherein said electrical conductor is a silver braze, said silver braze operable to electrically join said pin member and said collar.

31. The terminal assembly of claim 22, wherein said first insulator is a glass-to-metal seal.

32. The terminal assembly of claim 22, wherein said second insulator is bonded to an opposite side of said first insulator and said collar by a bonding material.

33. The terminal assembly of claim 32, wherein said bonding material is an epoxy.

34. The terminal assembly of claim 22, wherein said second insulator extends beyond one of said first and second ends of said annular sleeve to provide oversurface protection between said pin assembly and said annular sleeve.

35. The terminal assembly of claim 22, wherein said annular sleeve includes an external threaded portion, said external threaded portion operable to attach said hermetic assembly to a corresponding threaded bore.

36. A hermetically sealed current conducting terminal assembly comprising:

an annular sleeve comprising a bore and a first and second end;

a pin assembly disposed within said bore of said sleeve;

a first insulator disposed between said bore of said sleeve and said pin assembly comprising a glass-to-metal seal, said first insulator electrically insulating said pin assembly from said sleeve;

said pin assembly comprising:

a pin member; and a core comprising a collar axially surrounding said pin member; and a second insulator comprising at least one ceramic sleeve disposed about said pin member and adjacent to said first insulator.

37. The terminal assembly of claim 36, wherein said pin member includes a first pin member and a second pin member.

38. The terminal assembly of claim 37, wherein said first pin member is electrically connected to said second pin member by said core.

39. The terminal assembly of claim 36, wherein said collar is made from stainless steel.

40. The terminal assembly of claim 36, wherein each said ceramic sleeve is bonded to an opposite side of said first insulator by a bonding material.

41. The terminal assembly of claim 40, wherein said bonding material is an epoxy.

42. The terminal assembly of claim 36, wherein each said ceramic sleeve extends beyond one of said first and second ends of said annular sleeve to provide oversurface protection between said pin assembly and said annular sleeve.

43. The terminal assembly of claim 36, wherein said annular sleeve includes an external threaded portion, said external threaded portion operable to attach said hermetic assembly to a corresponding threaded bore.

44. The terminal assembly of claim 36, wherein said core is made from copper.

45. The terminal assembly of claim 36, wherein said core is made from brass.

46. A hermetically sealed current conducting terminal assembly comprising:

an annular sleeve comprising a bore and a first and second end;

a pin assembly disposed within said bore of said sleeve;

a first insulator disposed between said bore of said sleeve and said pin assembly comprising a glass-to-metal seal, said first insulator electrically insulating said pin assembly from said sleeve;

said pin assembly comprising:

a first pin member extending in a first direction along a longitudinal axis, said first pin member having a proximal end;

a second pin member extending in a second direction along said longitudinal axis, said second pin member having a proximal end; and a core operable to connect said first pin member and said second pin member; and a second insulator comprising a pair of ceramic sleeves disposed about the respective proximal ends of the first and second pin members and adjacent to said first insulator.

47. The terminal assembly of claim 46, wherein said core includes a stud portion having a first threaded extension and a second threaded extension and a collar axially surrounding a portion of said stud portion, said first threaded extension extending in said first direction and said second extension extending in said second direction.

48. The terminal assembly of claim 47, wherein said first pin member includes a first threaded bore and said second pin member includes a second threaded bore, said first threaded bore operable to matingly receive said first threaded extension and said second threaded bore operable to matingly receive said second threaded extension.

49. The terminal assembly of claim 47, wherein said collar and said stud portion have a unitary construction.

50. The terminal assembly of claim 46, wherein said first member includes a distal end opposing said proximal end and said second member includes a distal end opposing said proximal end, each of said distal end of said first member and said distal end of said second pin member including a series of threads.

51. The terminal assembly of claim 46, wherein said core includes a central member having an outer diameter generally equivalent to that of said first and second pin members, said core fused to said first insulator.

52. The terminal assembly of claim 46, wherein each said ceramic sleeve is bonded to an opposite side of said first insulator by a bonding material.

53. The terminal assembly of claim 52, wherein said bonding material is an epoxy.

54. The terminal assembly of claim 46, wherein each said ceramic sleeve extends beyond one of said first and second ends of said annular sleeve in one of said first and second directions to provide oversurface protection between said pin assembly and said annular sleeve.

55. The terminal assembly of claim 46, wherein said annular sleeve includes an external threaded portion, said external threaded portion operable to attach said hermetic assembly to a corresponding threaded bore.

56. The terminal assembly of claim 46, wherein said core is made from copper.

57. The terminal assembly of claim 46, wherein said core is made from brass.

* * * * *